US005431118A

United States Patent [19]

Cash

[11] Patent Number: 5,431,118

[45] Date of Patent: Jul. 11, 1995

[54] DRY SEWING MACHINE INCLUDING LOOP SPREADER

[75] Inventor: David R. Cash, Louisville, Ky.

[73] Assignee: James Cash Machine Co., Inc., Louisville, Ky.

[21] Appl. No.: 289,883

[22] Filed: Aug. 12, 1994

[51] Int. Cl.[6] ..... D05B 61/00; D05B 71/00

[52] U.S. Cl. ..... 112/199; 112/256; 112/302; 112/221

[58] Field of Search ..... 112/199, 162, 177, 168, 112/221, 220, 235, 237, 284, 303, 256, 302; 384/484

[56] References Cited

U.S. PATENT DOCUMENTS

| | | | |
|---|---|---|---|
| 2,692,569 | 10/1954 | Ketterer | 112/221 X |
| 3,140,129 | 7/1964 | Koss | 384/484 X |
| 3,753,410 | 8/1973 | Kostenowczyk | 112/168 X |
| 4,108,096 | 8/1978 | Ciecior | 112/221 |
| 4,333,410 | 6/1982 | Taketomi | 112/168 X |
| 4,357,887 | 11/1982 | Hara et al. | 112/190 X |
| 4,665,845 | 5/1987 | Card et al. | 112/221 X |
| 4,974,534 | 12/1990 | Eberhahn et al. | 112/199 |
| 4,984,526 | 1/1991 | Ide et al. | 112/199 X |

*Primary Examiner*—Clifford D. Crowder
*Assistant Examiner*—Ismael Izaguirre
*Attorney, Agent, or Firm*—Middleton & Reutlinger; James C. Eaves, Jr.

[57] ABSTRACT

A dry sewing machine, or a sewing machine which can be operated without oiling. The machine of the preferred embodiment is particularly adapted for making a type 401 two thread chain stitch, used in commercial sewing operations. In addition to employing sealed bearings, novel spreader and rocker frame assemblies are employed.

8 Claims, 5 Drawing Sheets

DRY SEWING MACHINE INCLUDING LOOP SPREADER

BACKGROUND OF THE INVENTION (a) Field of the Invention

The present invention relates to a dry sewing machine, or a sewing machine which can be operated without oiling. The machine of the preferred embodiment is particularly adapted for making a type 401 two thread chain stitch, used in commercial sewing operations. In addition to employing sealed bearings, novel spreader and rocker frame assemblies are employed.

(b) Description of the Prior Art

The present invention relates to a dry sewing machine. Known commercial sewing machines, such as the model 300U made by The Singer Company, often have 15 or more oiling points, which should be oiled every 8 or so hours of operation, causing machine downtime. Some machines, such as the 300W made by The Singer Company, employ oil pans and wicking systems to transfer oil to parts needing oil. Because commercial sewing machines are sometimes employed with other machines, such as a tape edge machine used in sewing mattress covers, where the machine is not "level" during operation, the effectiveness of an oil pan and wicking system can be reduced, leading to wear on the parts needing to be oiled.

In making a 401 chain stitch, an upper thread and a lower thread are used. The upper thread passes through the needle eye and the lower thread passes through the looper eye. A spreader is employed to position the lower thread on the correct side of the needle during the sewing operation. Typically, in commercial sewing, about six or seven 401 chain stitches per inch are made. Various sewing manuals describe the 401 chain stitch and how it is made. For example, the Union Special Corporation has a 1976 copyrighted booklet entitled Stitch Formation, Type 401, incorporated herein by reference.

The needle, spreader, and looper operate in concert to make the stitch, all making one coordinated cycle. In one coordinated cycle, when looking at the front of the sewing machine, the needle moves from high position to low position to high position, the looper moves from almost far left position to far left position to far right position to almost far left position, and the looper moves from far forward position to furthest back position to far forward position. For example, the spreader moves a total distance of about ¼ inch or 6.35 mm from its far left position, which is to the left of the needle and left of the looper, to its far right position, to the right of the needle. The looper is to the left of the needle. A compound material feeding system exists, as the needle, presser foot, and lower feed dog operate in unison.

In commercial sewing machine models made by The Singer Company, such as the model 300U103, a comparatively complicated eccentric mechanism is employed to accomplish the spreader left/right movement. This mechanism requires oiling. Simply, an off-centered wheel on a main shaft causes a first transverse shaft to oscillate back and forth. The first shaft is connected to a transverse second shaft which holds the spreader. This second shaft, and therefore the spreader, moves back and forth the entire required ¼ inch or 6.35 mm.

SUMMARY OF THE INVENTION

The present invention is for a dry sewing machine with improved features. A pair of miter gears are employed, the first gear being mounted onto the drive shaft, the second gear being transverse to the first gear and having, for example, in the preferred embodiment, a center shaft with a bore off-set 1/16inch or 1.59 mm from center. A pin in the bore then moves left/right ⅛ inch or 3.18 mm during a complete revolution of the second gear shaft. The spreader is attached to a generally upright pivotal bar, the bar having a first distance "x" from a lower pivot point to the upper spreader. At a location about half-way between the pivot point and the spreader, or a distance x/2 from the pivot point, is connected a generally horizontal bar. The other end of this generally horizontal bar is connected to the pin in the off-set bore in the second gear shaft. Therefore, as the pin, and thus the generally horizontal bar move left/right ⅛ inch or 3.18 mm during a complete revolution of the second gear shaft, the generally upright pivotal bar pivots about the lower pivot point and the upper spreader, being twice as far from the pivot point as the generally horizontal bar, moves left/right the required ¼ inch or 6.35 mm. The miter gear configuration is the key to making the sewing machine which does not require oiling. The 2 to 1 ratio (¼ inch or 6.35 mm to ⅛ inch or 3.18 mm) in movement of the spreader bar to the generally horizontal bar results in reduced machine vibration at the same number of revolutions per minute when compared to conventional machines where the spreader bar and its connected "second transverse shaft" both move ¼ inch or 6.35 mm. Other ratios are easily employed, if desired.

With the miter gear configuration, the bearings throughout the sewing machine can be replaced with sealed bearings, resulting in a dry sewing machine which does not require external oiling. For example, bearings are employed in the compound material feeding system, the needle assembly, and the looper assembly.

A novel rocker frame is employed. The rocker frame is employed with the compound material feeding system, where the needle, presser foot, and lower feed dog operate in concert to feed the material being sewn. The rocker frame contains the needle shaft and the presser foot shaft, both shafts being vertically moveable within respective bores. As the movement of these shafts over time can "enlarge" the bores, means for reducing the bore diameters are employed. By placing a vertical slit in the rocker frame, which communicates with the respective bore, and by placing a horizontal bore through the opposing vertical slit faces, a screw can be used to "pull" the faces closer together, thereby reducing the diameter of the respective bore. This adjustability is important for longer rocker frame life, particularly in a dry sewing machine.

Finally, the present invention comprises a sewing machine having a spreader assembly, having: a rotatable shaft having an axially-aligned first gear thereon; a second gear transverse to the first gear and meshing therewith, the second gear having a central shaft extending therefrom, the central shaft having a center axis, the central shaft having a bore therein, the bore being parallel to the center axis, the bore being a preselected bore distance from the center axis; a pivot pin and a generally upright bar having a top and a bottom, the bar having a spreader attached at the top, the bar being pivotally connected to a pivot pin toward the bottom, the spreader being a first preselected distance from the pivot pin, the bar having a connection point, the connection point being a second preselected distance from the pivot pin, the first preselected distance divided by the second preselected distance defining a ratio; a generally horizontal bar assembly having a shaft end and a spreader end, the shaft end and the second gear central shaft bore having a connection therebetween, the spreader end and the generally upright bar connection point having a connection therebetween; whereby, in a sewing cycle, the generally horizontal bar assembly moves a first horizontal distance, the first horizontal distance being equal twice the preselected bore distance; and, the spreader moves a second horizontal distance, the second horizontal distance being equal twice the preselected bore distance multiplied by the ratio.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
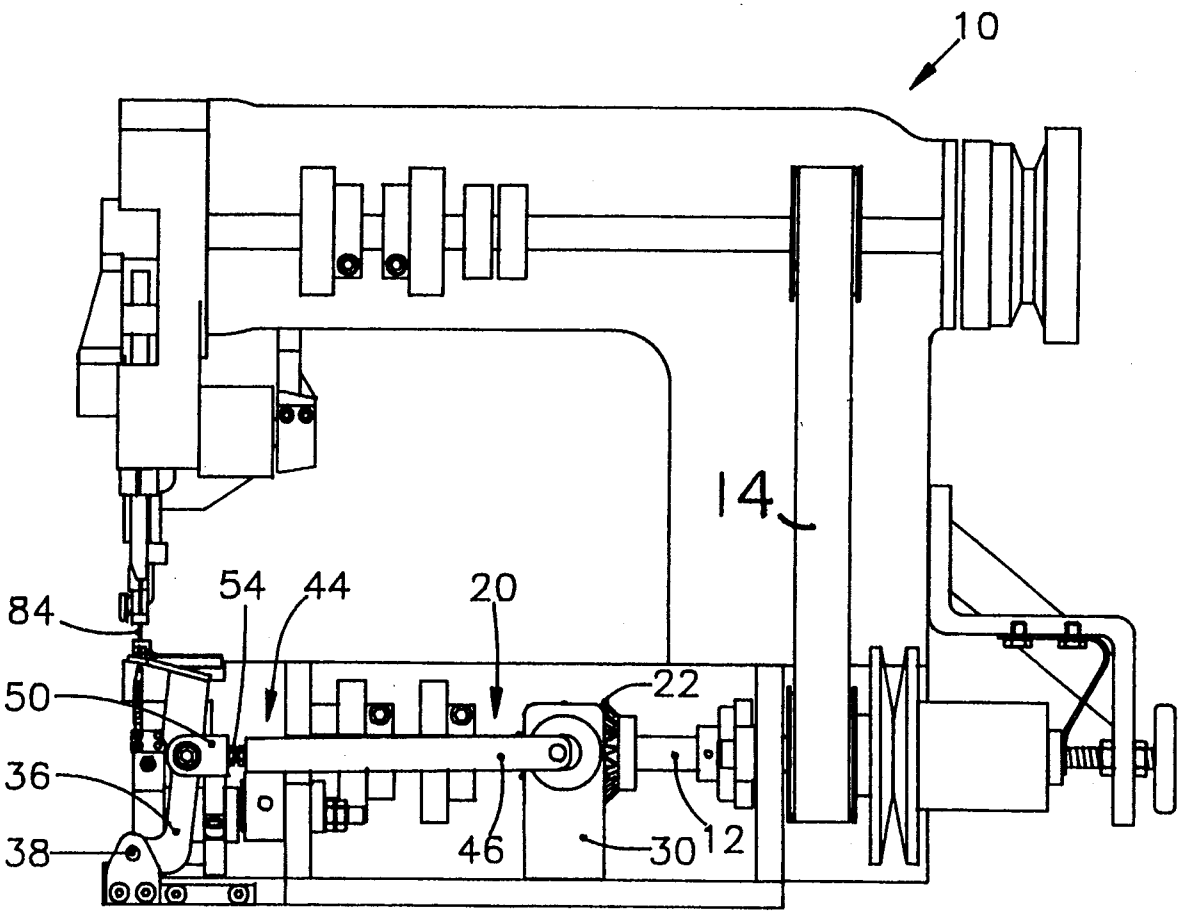
FIG. 1 shows a front view of the sewing machine of the preferred embodiment having portions of the sewing machine casing removed.
Figure 2:
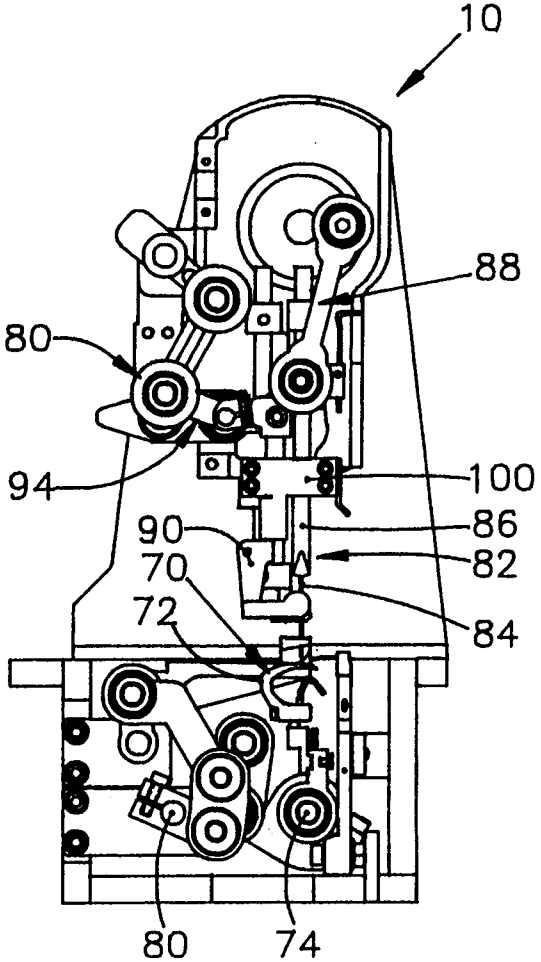
FIG. 2 shows a left end view of the sewing machine of the preferred embodiment having portions of the sewing machine casing removed.
Figure 3:
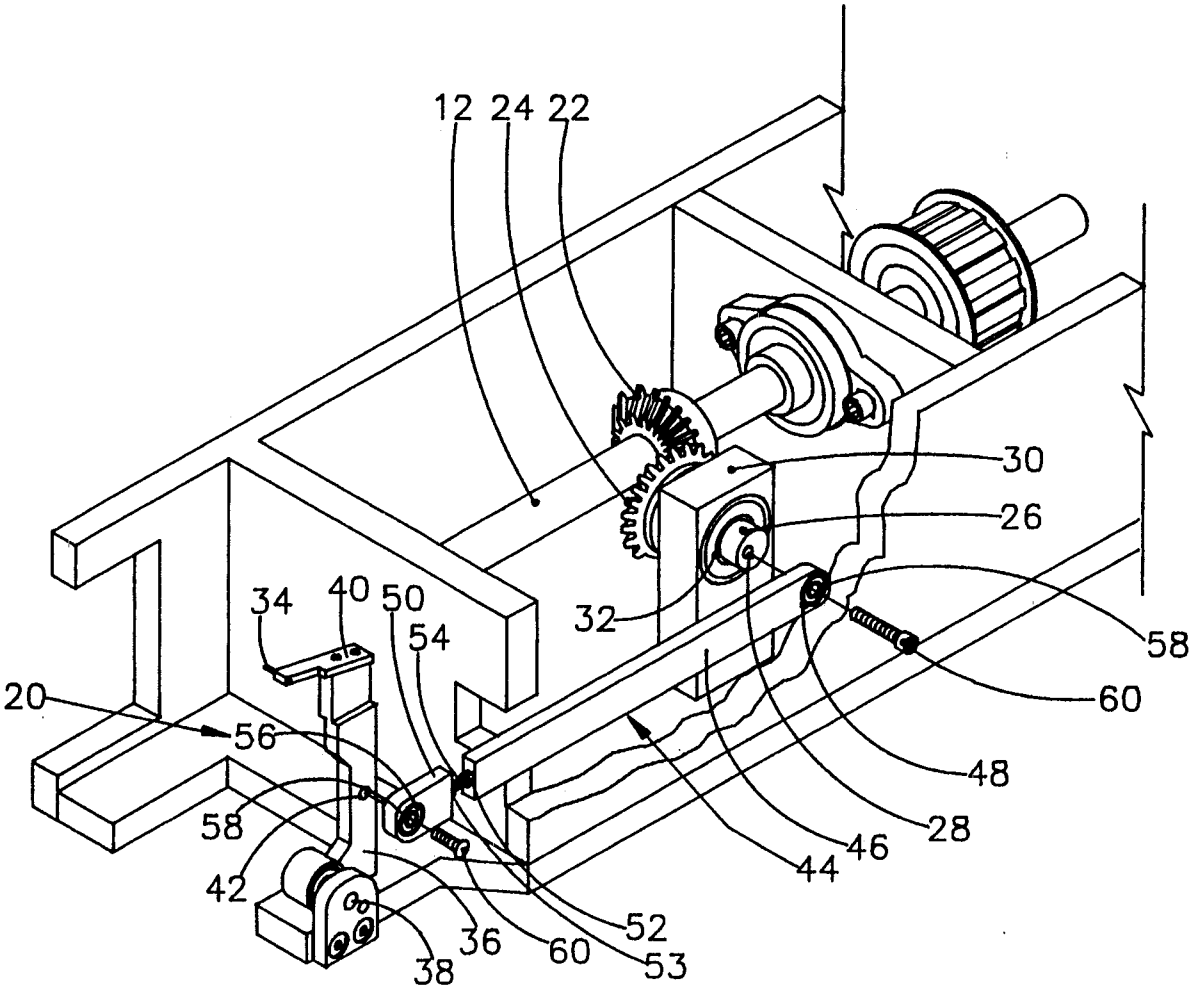
FIG. 3 shows a perspective view of the transverse gears and the spreader assembly of the preferred embodiment.

With reference to the Figures, the dry sewing machine 10 of the preferred embodiment of the present invention is shown. Having a spreader assembly 20 which does not require external oiling is key to making a dry sewing machine. A pair of miter gears 22 and 24 are employed, the first gear 22 being mounted onto the drive shaft 12 which is driven by drive belt 14. The second gear 24 is mounted transverse to the first gear 22 and has, for example, a center shaft 26 with a bore 28 off-set 1/16inch or 1.59 mm from the center or axis of shaft 26. Bore 28 is parallel the axis of shaft 26. Center shaft 26 can be retained by a pair of sealed bearings 32 contained in bearing housing 30, bearing housing 30 being connected to the case of sewing machine 10.

Figure 4:
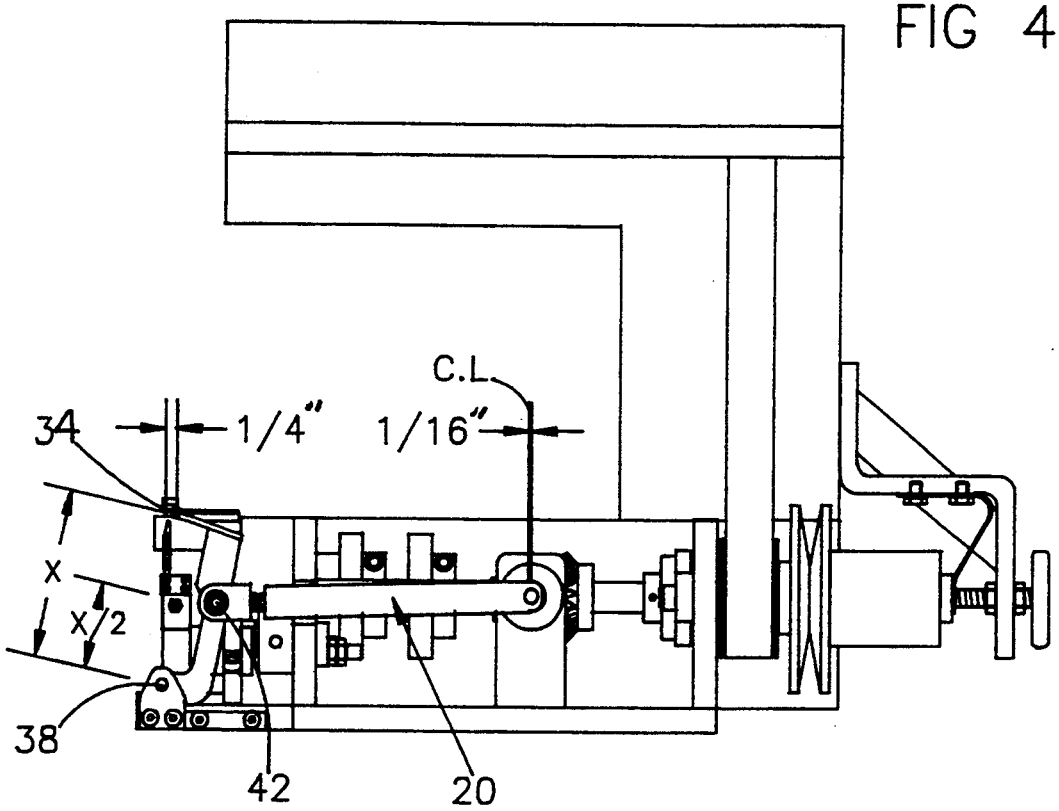
FIG. 4 shows a partial front view of the sewing machine of the preferred embodiment, the spreader being at its rightmost position.
Figure 5:
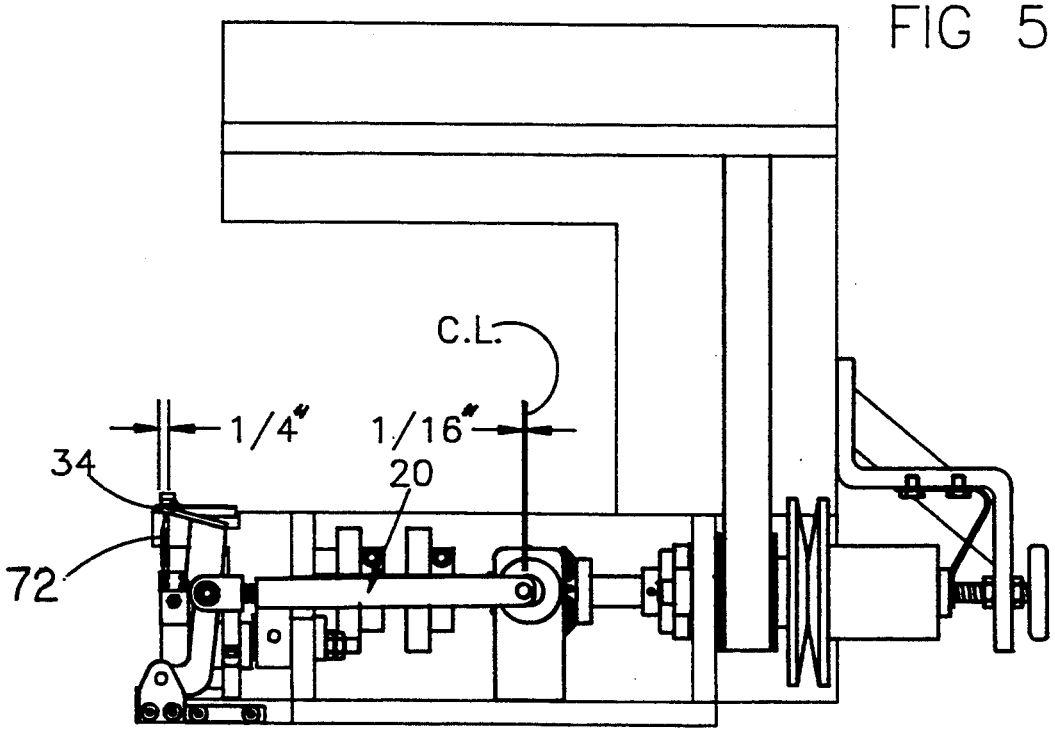
FIG. 5 shows a partial front view of the sewing machine of the preferred embodiment, the spreader being at its leftmost position.

A screw 60 to be connected into the bore 28 will then move left/right ⅛ inch or 3.18 mm during a complete revolution of the second gear shaft, as seen best in FIGS. 4 and 5. In FIG. 4, the screw 60 is 1/16inch or 1.59 mm to the right of the center or axis of shaft 26, the center being designated "c.l." for center line. In FIG. 5, the screw 60 is 1/16inch or 1.59 mm to the left of the c.l.

The spreader 34 is attached to a generally upright pivotal bar 36, the bar 36 having a first distance "x" from a lower pivot point 38 to the upper spreader 34, the spreader 34 connected to an assembly which is attached to bar 36 at spreader top portion 40. At a location about half-way between the pivot point 38 and the spreader 34, or a distance x/2 from the pivot point 38, is connected a generally horizontal bar assembly 44 using, for example, a screw 60. The distances "x" and "x/2" are identified in FIG. 4. The other end of this generally horizontal bar assembly 44 is connected to the screw 60 in the off-set bore 28 in the second gear 24 shaft 26.

As shown in the preferred embodiment, generally horizontal bar assembly 44 is shown having means for adjusting its horizontal length. Bar assembly 44 is shown having a long bar 46, a short bar 50, and a threaded rod 54 connectable therebetween to adjust the length. Long bar 46 has a bearing bore 48 toward one end and a threaded bore 52 into its other end. Short bar 50 has an upright bar bore 56 toward one end and a threaded bore 53 into its other end. Threaded rod 54 is threadably received by bores 52 and 53. Bushings 58 can be placed into bores 48 and 56 and screws 60 threaded thereinto to be received further by bores 28 and 42, respectively.

Therefore, as the screw 60 in bore 28, and thus the generally horizontal bar assembly 44 move the maximum left/right distance of ⅛ inch or 3.18 mm during a complete revolution of the second gear shaft 26, the generally upright pivotal bar 36 pivots about the lower pivot point 38 and the spreader 34, being twice as far from the pivot point 38 (the distance "x") as the generally horizontal bar assembly 44 (the distance "x/2"), moves left/right the required ¼ inch or 6.35 mm.

The miter gear 22/24 configuration is the key to making the dry sewing machine. The 2 to 1 ratio (¼ inch or 6.35 mm to ⅛ inch or 3.18 mm) in movement of the spreader 34 to the generally horizontal bar assembly 44 results in reduced machine vibration at the same number of revolutions per minute, when compared to conventional machines where the spreader bar and its connected "second transverse shaft" both move ¼ inch or 6.35 mm. Other ratios are easily employed, if desired, such as, for example, by altering the distance bore 28 is off-set from the axis of shaft 26 and/or by moving the connection point on bar 36 where bar assembly 44 is connected either closer to pivot point 38 (larger ratio) or closer to spreader 34 (smaller ratio).

Figure 6:
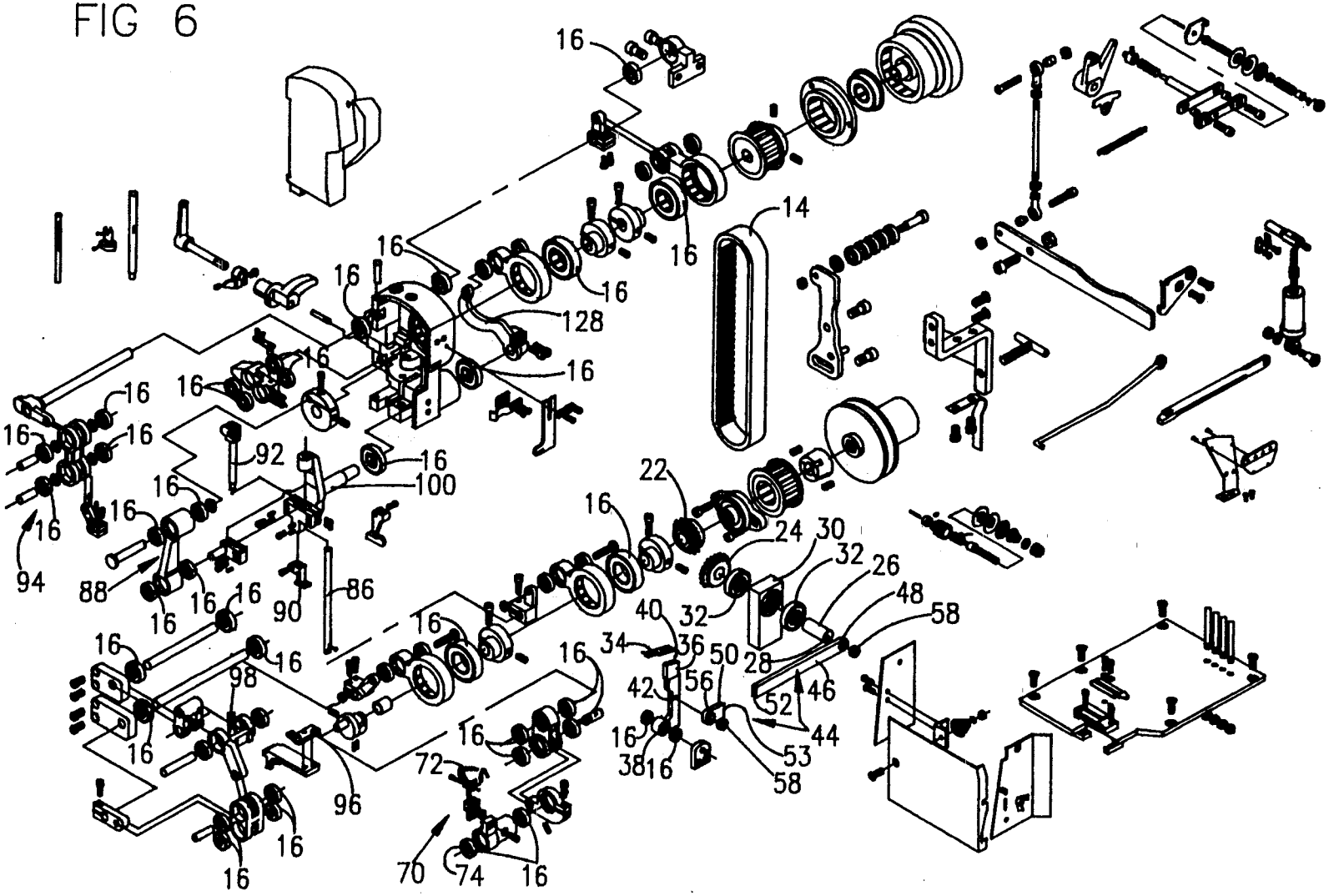
FIG. 6 shows a partial exploded view of the sewing machine of the preferred embodiment; and, FIG. 7 shows a perspective view of the rocker frame assembly of the sewing machine of the preferred embodiment.
Figure 7:
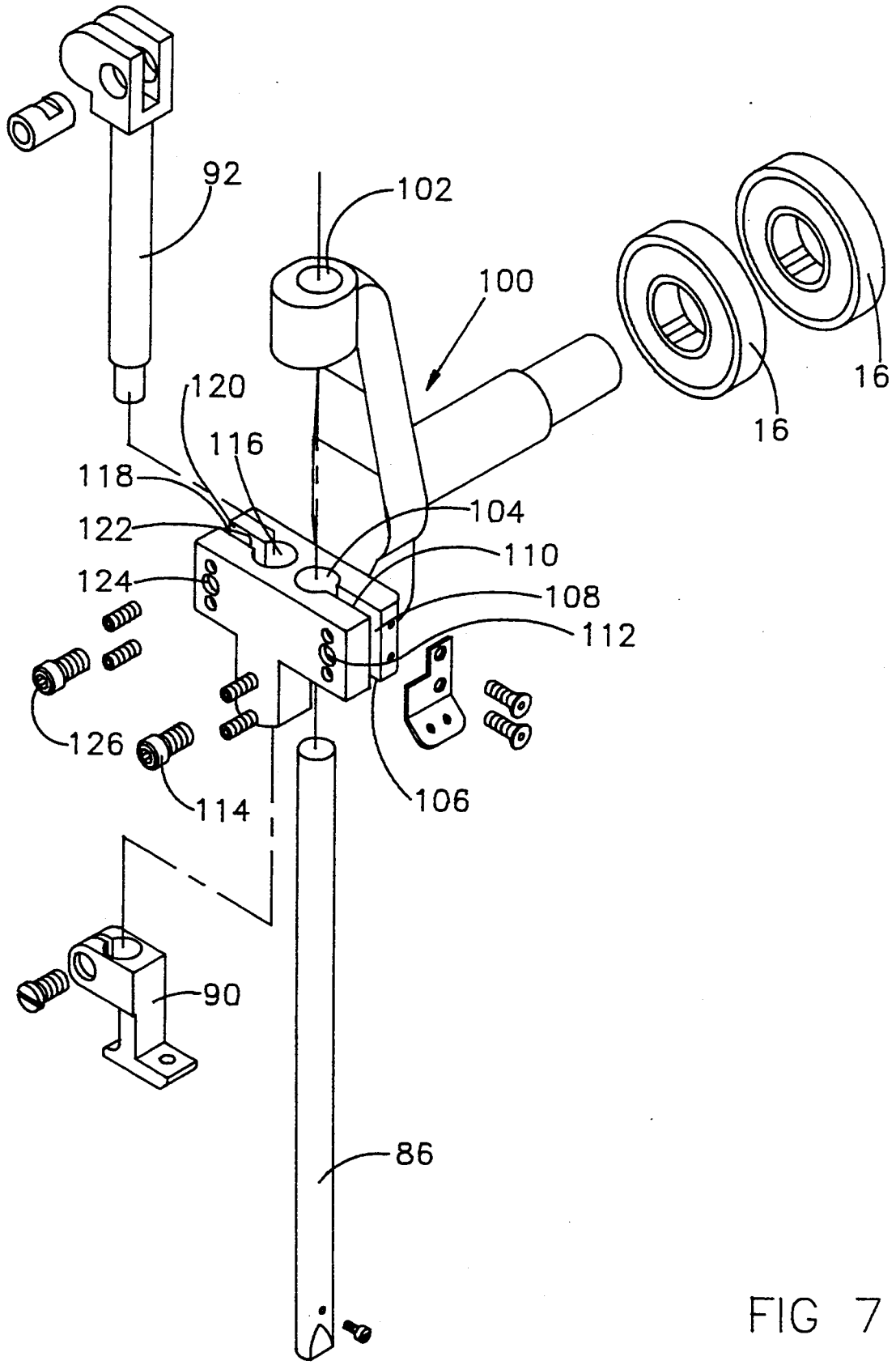

The bearings throughout the sewing machine can be replaced with sealed bearings, resulting in the dry sewing machine 10, which does not require external oiling. A plurality of sealed bearings 16 are identified in FIG. 6. For example, sealed bearings 16 are employed in the compound material feeding system 80 with the needle assembly 82 and the looper assembly 70.

Looper assembly 70, having looper 72, and looper pivot point 74 function as in prior art machines, the looper 72 moving in a front to back to front movement, when looking at machine 10 from the front view of FIG. 1. The spreader 34 also functions as in prior art machines, the spreader 34 moving in a right to left to right movement, when looking at machine 10 from the front view of FIG. 1. The compound material feeding system 80 also functions as in prior art machines, the needle 84 of the needle assembly 82 moving up and down, when looking at machine 10 from the front view of FIG. 1.

However, a novel rocker frame 100 is employed. The rocker frame 100 is employed with the compound material feeding system 80, where the needle 84, presser foot 90, lower feed dog 96, and rocker frame 100, as controlled by respective needle drive eccentrics 88, presser foot eccentrics 94, lower feed dog eccentrics 98, and rocker frame eccentrics 128, operate in concert to feed the material being sewn by machine 10.

The rocker frame 100 contains the needle shaft 86 and the presser foot shaft 92, both shafts 86 and 92 being vertically moveable within respective bores 102/104 and 116, bore 102 being an upper needle shaft bore, bore 104 being a lower needle shaft bore, and bore 116 being a pressure foot shaft bore. As the movement of these shafts 86 and 92 over time can "enlarge" the bores 102/104 and 116, means for reducing the bore diameters are employed. By placing vertical slits 106 and 118 in the rocker frame 100, the slits 106 and 118 communicating with the respective lower needle shaft bore 104 and pressure foot shaft bore 116, and by placing respective horizontal bores 112 and 124 through the respective opposing vertical slit faces 108/110 and 120/122, respective screws 114 and 126, functioning as adjusting means, can be used to "pull" the respective faces 108/110 and 120/122 closer together, thereby reducing the diameter of the respective bores 104 and 116. This adjustability is important for longer rocker frame 100 life, particularly in dry sewing machine 10.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A sewing machine having a spreader assembly, comprising:

a. a rotatable shaft having an axially-aligned first gear thereon;

b. a second gear transverse to said first gear and meshing therewith, said second gear having a central shaft extending therefrom, said central shaft having a center axis, said central shaft having a bore therein, said bore being parallel to said center axis, said bore being a preselected bore distance from said center axis;

c. a pivot pin and a generally upright bar having a top and a bottom, said bar having a spreader attached at said top, said bar being pivotally connected to the pivot pin toward said bottom, said spreader being a first preselected distance from said pivot pin, said bar having a connection point, said connection point being a second preselected distance from said pivot pin, said first preselected distance divided by said second preselected distance defining a ratio;

d. a generally horizontal bar assembly having a shaft end and a spreader end, said shaft end and said second gear central shaft bore having a connection therebetween, said spreader end and said generally upright bar connection point having a connection therebetween;

e. whereby, in a sewing cycle, said generally horizontal bar assembly moves a first horizontal distance, said first horizontal distance being equal twice said preselected bore distance; and, said spreader moves a second horizontal distance, said second horizontal distance being equal twice said preselected bore distance multiplied by said ratio.

2. The sewing machine of claim 1, where said ratio is two.

3. The sewing machine of claim 2, where said preselected bore distance is 1/16inch (1.59 mm).

4. The sewing machine of claim 1, further comprising a sealed bearing assembly, said sealed bearing assembly supporting said second gear central shaft.

5. The sewing machine of claim 1, further comprising:

a compound material feeding system including a needle assembly and a looper assembly; whereby said compound material feeding system including said needle assembly and said looper assembly employ a plurality of sealed bearing assemblies so as to make said sewing machine a sewing machine which does not require oiling.

6. The sewing machine of claim 1, further comprising a rocker frame assembly, said rocker frame assembly having:

a. an upper and a lower generally vertically aligned needle shaft bores, said lower needle shaft bore having a needle shaft bore diameter, said upper and lower needle shaft bores receiving a needle shaft, said needle shaft being vertically moveable, said lower needle shaft bore including means for reducing said lower needle shaft bore diameter; and, b. a generally vertical presser foot shaft bore having a presser foot shaft bore diameter, said presser foot shaft bore receiving a presser foot shaft, said presser foot shaft being vertically moveable, said presser foot shaft and said needle shaft being in a parallel relationship, said presser foot shaft bore including means for reducing said presser foot shaft bore diameter.

7. The sewing machine of claim 6, a. where said means for reducing the presser foot shaft bore diameter includes a first generally vertical slit in said rocker frame assembly, said first slit in communication with said presser foot shaft bore, said first slit having a pair of opposing first slit walls having a first slit spacing therebetween, said pair of opposing first slit walls including means for adjusting said first slit spacing; and, b. where said means for reducing the lower needle shaft bore diameter includes a second generally vertical slit in said rocker frame assembly, said second slit in communication with said lower needle shaft bore, said second slit having a pair of opposing second slit walls having a second slit spacing therebetween, said pair of opposing second slit walls including means for adjusting said second slit spacing.

8. The sewing machine of claim 1, where said generally horizontal bar assembly has a length, said generally horizontal bar assembly including means for adjusting said length.

* * * * *